US010718117B2

(12) United States Patent
Noble

(10) Patent No.: US 10,718,117 B2
(45) Date of Patent: Jul. 21, 2020

(54) PANEL SUPPORT SYSTEM AND METHOD

(71) Applicant: Pure Vista Ltd, Bodmin, Cornwall (GB)

(72) Inventor: Angus Noble, Totnes (GB)

(73) Assignee: PURE VISTA LTD, Bodmin, Cornwall (GB)

( * ) Notice: Subject to any disclaimer, the term of this patent is extended or adjusted under 35 U.S.C. 154(b) by 0 days.

(21) Appl. No.: 16/020,556

(22) Filed: Jun. 27, 2018

(65) Prior Publication Data

US 2019/0301168 A1 Oct. 3, 2019

(30) Foreign Application Priority Data

Mar. 29, 2018 (GB) ..... 1805239.9

(51) Int. Cl.
*E04F 11/18* (2006.01)

(52) U.S. Cl.
CPC ..... *E04F 11/1834* (2013.01); *E04F 11/1812* (2013.01); *E04F 11/1853* (2013.01)

(58) Field of Classification Search
CPC ..... E04F 11/1834; E04F 11/1812; E04F 11/1853
See application file for complete search history.

(56) References Cited

U.S. PATENT DOCUMENTS 4,920,717 A * 5/1990 Hooper, Jr. ..... E04F 11/1851 52/204.597
6,419,209 B1 * 7/2002 Shepherd ..... E04F 11/1853 256/24
8,820,721 B1 * 9/2014 Poma ..... E04F 11/1812 256/24
8,826,621 B2 9/2014 Noble
9,657,760 B2 * 5/2017 Giacometti ..... F16B 9/023
9,816,276 B2 11/2017 Noble
10,030,393 B2 * 7/2018 Spence ..... E04F 11/1812
10,557,270 B2 * 2/2020 Groeneweg ..... E04F 11/18
2001/0025953 A1 * 10/2001 Shepherd ..... E04F 11/1851 256/24
2013/0036680 A1 * 2/2013 Noble ..... E04F 11/1851 52/126.4
2015/0197959 A1 * 7/2015 Tinwala ..... E04H 17/16 256/24

(Continued)

FOREIGN PATENT DOCUMENTS

FR 3055138 2/2018
GB 2490642 A * 11/2012 ..... E04F 11/1851

(Continued)

OTHER PUBLICATIONS

UKIPO search and examination report, dated Sep. 25, 2018.
EPO search report dated, Nov. 26, 2018.

*Primary Examiner* — Rodney Mintz
(74) *Attorney, Agent, or Firm* — Crose Law LLC; Bradley D. Crose

(57) ABSTRACT

Panel support systems that allow for adjustability are not necessarily as robust as some non-adjustable systems. The present invention is a system for adjusting alignment of a flat panel 1 that includes at least one pair of resilient barrier units 21 configured to be placed in a trough 3 at opposing ends of an adjustment part 11. Liquid resin 29 may then be inserted between the barrier units 21 and allowed to harden.

6 Claims, 3 Drawing Sheets

(56) References Cited

U.S. PATENT DOCUMENTS

| | | | | |
|---|---|---|---|---|
| 2015/0240851 | A1* | 8/2015 | Giacometti | F16B 9/023 403/374.3 |
| 2015/0267415 | A1* | 9/2015 | Zhou | E04F 11/1853 52/208 |
| 2016/0265232 | A1* | 9/2016 | Noble | E04F 11/1834 |
| 2016/0281366 | A1* | 9/2016 | Spence | E04F 11/1812 |
| 2017/0101784 | A1* | 4/2017 | Gonzato | E04F 11/1812 |
| 2017/0370108 | A1* | 12/2017 | Groeneweg | E04F 11/1836 |
| 2018/0135669 | A1* | 5/2018 | Dagand | F16B 2/14 |
| 2019/0024380 | A1* | 1/2019 | Noble | E04F 11/1812 |
| 2019/0218786 | A1* | 7/2019 | Bieler | E04F 11/1812 |
| 2019/0249442 | A1* | 8/2019 | Strehlow | E04F 11/1851 |

FOREIGN PATENT DOCUMENTS

| | | | | |
|---|---|---|---|---|
| GB | 2528147 | | 1/2016 | |
| WO | WO-2016024299 | A1 * | 2/2016 | E06B 3/5454 |

* cited by examiner

PANEL SUPPORT SYSTEM AND METHOD

CROSS-REFERENCE TO RELATED APPLICATION(S)

The present non-provisional patent application claims the benefit of priority of GB Patent No. 1805239.9, filed Mar. 29, 2018, which is entitled "PANEL SUPPORT SYSTEM AND METHOD", which is incorporated in full by reference herein.

FIELD OF THE INVENTION

The present invention relates generally to panel support systems and a method of supporting panels and finds particular, although not exclusive, utility in positioning and installing flat panels.

BACKGROUND OF THE INVENTION

Panels, in particular flat panels, are often made of glass, acrylic, metal, plastics material and/or other hard materials. Such panels may comprise two opposing faces, which may be flat or may be curved, regular or irregular, and a perimeter wall joining the two opposing faces. The perimeter wall may comprise a base.

It is known for balustrades and partitions to be formed from a flat panel and for such panels to be anchored along a lower edge and substantially unsupported at an upper edge. Known methods of supporting these panels include placing a lower edge into a trough and clamping the panel in place.

It is desirable for these panels to be arranged/aligned vertically, both for aesthetic reasons, and to ensure that their centre of mass acts through their footprint, thereby reducing constant torque on their support mechanisms. Conventionally, this has been achieved by ensuring that the trough is itself precisely aligned on a horizontal, such that any flat panel inserted therein stands in a vertical plane.

UK Patents GB2490642 and GB2528147 describe alternative mechanism for supporting a flat panel in a vertical alignment, whereby the angle of the panel can be adjusted after insertion. Thus, a trough may be placed on an approximately horizontal surface, or a surface that may be subject to subsidence, and for alignment of a panel to be achieved at a later point.

However, such systems allow for adjustability, but are not necessarily as robust as some non-adjustable systems. For example, in the event of an explosion, such as a terrorist incident, a shockwave due to air pressure changes may act on a secured panel over its entire surface area. Although the force is relatively low and may not damage the panel, the force is spread over a relatively large area of the panel and therefore may cause a significant torque on the panel support mechanism. It is therefore desirable to find a more robust support system.

BRIEF SUMMARY OF THE INVENTION

According to a first aspect of the present invention, there is provided a system for adjusting alignment of a flat panel, the system comprising: a longitudinal trough having two opposing side walls and a base connected therebetween, the trough being open on a side opposing the base, the trough configured to be attachable to a surface; a gripping part for securely holding a section of the flat panel, the gripping part having a contact surface for engaging with a face of the flat panel and a first joint surface inclined obliquely to the contact surface, the gripping part locatable within the longitudinal trough with the joint surface at least partially facing the open side of the trough opposing the base; an adjustment part having a first end configured to be engaged with one of the side walls of the trough, the adjustment part having a second joint surface spaced from the first end of the adjustment part by a distance that is adjustable by a user, the second joint surface arrangable in contact with the first joint surface to form a joint, wherein changing the distance between the second joint surface and the first end of the adjustment part results in: a force being applied by the second joint surface onto the first joint surface, resulting in the gripping part gripping the panel and urging the panel toward the base of the trough; and pivoting of the panel within the trough about an axis parallel to a longitudinal length of the trough; and at least one pair of resilient barrier units configured to be placed in the trough at opposing ends of the adjustment part to prevent liquid resin flowing along a length of the trough.

In this way the easily adjustable system of the prior art can be made more robust against terrorist attacks, thereby improving safety. In particular, a panel may be secured within a trough with a reduced amount of resin, by only applying resin the barrier units rather than along an entire length of the trough.

The resin may comprise natural plant resin and/or synthetic resin. The resin may comprise a thermosetting plastics material, for example (poly) methyl methacrylate. The resin may comprise a first one of two monomers in a copolymer, the second one of the two monomers may comprise a hardener, for example the resin may comprise a polyester and/or epoxy resin.

The resilient barrier units may be shaped to match an interior profile of the trough to one side a panel therein. The resilience of the barrier units enables the units to match the interior profile of the trough over a range of inclinations of the panel.

The adjustment part may be configured to seal a region within the trough between the pair of resilient barrier units.

The adjustment part may further comprise a resin inlet, for introduction of resin into the region therethrough. The inlet may comprise a hole. The inlet may comprise a tube; the tube may be removable after use, for instance be breaking/cutting off. Each resilient barrier unit may comprise a cellular structure.

The cellular structure may comprise an open and/or closed cellular structure. The cellular structure may comprise a foam. The foam may comprise open cell foam and/or close cell foam. The foam may be a polymer foam. The foam may comprise a sponge.

The gripping part may comprise a single gripping part, at least one gripping part, at least two gripping parts or a plurality of gripping parts.

The adjustment part may comprise a single adjustment part, at least one adjustment part, at least two adjustment parts or a plurality of adjustment parts.

The first end may be a fixed end, which may be configured to be connected to one of the side walls of the trough. Alternatively, the first end may be movable, for instance slidable and/or pivotable, against the side wall of the trough. For example, the first end and the side wall may be shaped for mutual engagement. Changing the distance between the second joint surface and the first end of the adjustment part may comprise reducing or increasing the distance.

In this way, a panel may be aligned with its major face in a substantially vertical plane, even when the trough is located with its base substantially not horizontal. In particular, up to 10 degrees from horizontal, more particularly up to 5 degrees from horizontal, for instance up to 3 degrees from horizontal.

In addition, the force acting on the panel may have a component acting perpendicular to a major face of the panel (which acts to grip the panel) and another component acting substantially parallel to the major face of the panel (which urges the panel toward the base of the trough); that is, the panel may be held in the base of the trough by the force of the adjustment part on the first joint surface, thereby increasing stability of the panel.

Furthermore, adjustment of the panel may be made more simply than in prior art methods by means of the adjustment part being more accessible to a user.

The system may be configured such that, when in use, the adjustment part is under tension, and the gripping part may be under compression. The system may be configured such that, when in use, the adjustment part is not under compression. In this way, access to one end of the adjustment part may be easily provided for adjustment; that is, the side wall and the second joint surface each pull in opposing directions on the adjustment member, toward a middle of the adjustment member. In contrast, were the adjustment part under compression when in use, each end of the adjustment member would be obscured by parts of the system providing the compression; that is, the side wall would push on the first end of the adjustment member and an opposing end of the adjustment member would push on the gripping part.

The present invention may be usable with flat panels that have two opposing major faces, joined around a perimeter by for instance four or more minor faces. The major faces may define the plane of the panel, and the minor faces may define an edge of the panel. The major faces are substantially larger than the minor faces. The present invention may be usable with one or more shims and/or spacers located with a flat panel, for instance, against a major face of the flat panel. In particular, a shim/spacer may be placed between the flat panel and the gripping part, such that the gripping part may be used with flat panels having differing thicknesses. Alternatively or additionally, the gripping part may be adjustable for use with flat panels having different thicknesses. In some embodiments, the gripping part may comprise one or more of such shims/spacers. Each shim/spacer may be a flat sheet, which in some circumstances may be tapered or wedged, but is preferably of substantially uniform thickness. The shim/spacer may be made of metal, aluminium, silicone, rubber, synthetic rubber, wood, plastic material, composite material or any other suitable material. The shim/spacer may be approximately 1 mm, 2 mm, 2.5 mm, 3 mm, 4 mm or 5 mm thick (i.e. between major faces). A single or multiple shims/spaces may be used adjacent to a flat panel.

The trough may have a longitudinal axis, and may be substantially longer in a length parallel to the longitudinal axis than in a width or depth at right angles to the longitudinal axis. The side walls may extend along respective sides of the trough, parallel to the longitudinal axis. Similarly, the base may extend between the side walls, also substantially parallel to the longitudinal axis. Ends of the trough may be open or closed; that is, the ends substantially perpendicular to the side walls, the base and the longitudinal axis. The trough may be open on a side substantially opposing the base; that is, the side walls may be connected to one another at the base, and optionally the ends, but not at substantially any additional point. The open side opposing the base may be referred to as the top, even when the trough is located on a surface that is substantially non-horizontal, or is affixed to a surface at a non-zero angle to the base of the trough. The side walls may be spaced from one another. The trough may be integrally formed, formed by extrusion, moulding, or may be assembled from component parts, for instance by welding, bolting, screwing, gluing, etc. The trough may be a channel.

The trough may have a tapered cross-section; that is an internal width of the trough adjacent to the base may be less than an internal width of the trough adjacent to the open top. In particular, an internal width of the trough approximately mid-way up may be more than an internal width of the trough adjacent to the base. The gripping part may be configured to be wedgeable into the trough substantially adjacent to the base.

The trough may be configured to be removably or substantially permanently attachable to a surface. The trough may be configured to be set into a trench in a surface, such that the open side of the trough is substantially level with the surface. The trough may be attached to a surface such that it is horizontal; however, the present invention is capable of use when the trough is attached to a surface such that it is substantially non-horizontal. The trough may be screwed, glued, cemented, bolted or otherwise fixed to and/or into a surface.

The gripping part may securely hold a periphery of a flat panel, for instance a portion of the flat panel adjacent to a lower edge of the panel. The gripping part may engage a face of the flat panel immediately to a lower edge of the panel.

The gripping part may comprise a relatively high-friction surface for securely holding a section of the flat panel. The gripping part may comprise rubber material, synthetic rubber material, silicone rubber material and/or any other suitable form of resilient material. The contact surface may be substantially planar and/or flat. The contact surface may be substantially smooth; however, in preferred embodiments the contact surface is textured. For instance, the contact surface may comprise ridges, protuberances and/or dimples.

The first joint surface may be substantially non-parallel to the contact surface. The first joint surface may be substantially non-perpendicular to the contact surface. The first joint surface may be at an angle of between 20 and 70 degrees to the contact surface, and this angle may be measured about an axis that is substantially parallel to the longitudinal length of the trough. The angle may be between 30 and 60 degrees, in particular between 35 and 55 degrees, more particularly between 40 and 50 degrees, for example, approximately 40, 45 or 50 degrees.

The first and/or second joint surface may be a relatively low-friction surface; that is, the first and/or second joint surfaces may have a substantially lower friction than the contact surface.

In use, the joint surface may be facing upwards, and/or may be seen through the open side of the trough opposing the base (e.g. seen through the top of the trough).

The term 'connected' in relation to the adjustment part and the side walls is to be interpreted as substantially more than mere contact of the parts together. The adjustment part may be secured to the side wall, for instance by a cooperating engaging mechanism. The adjustment part may be removably or substantially permanently connected to the side wall of the trough. The adjustment part may be connected to the side walls by cooperating hooking parts, screw-threading parts, or by other suitable connection parts. The adjustment part may be integrally formed with the side walls, or may be glued, welded, or similarly affixed to the side wall. The adjustment part may be slidably received in a slot in the side wall, for instance by sliding in a direction substantially perpendicular to a direction in which the second joint surface is movable toward/away from the fixed end.

The distance between the second joint surface and the fixed end of the adjustment part may be configured to be adjusted with a screw-thread arrangement. For instance, the adjustment part may comprise a threaded shank and a cooperatively threaded nut may be provided on the shank such that rotation of the nut about the shank results in movement of the second joint surface along the shank. For example, the second joint surface may be provided on a sliding part having a central bore through which the threaded shank passes, and a nut may limit movement of the sliding part along the shank.

The adjustment part may comprises: an externally threaded shank having a head; a sliding part arranged to be slidably receivable on the threaded shank, the sliding part comprising the second joint surface arranged to face at least partially toward the fixed end of the adjustment part; and/or an internally threaded nut; and the sliding part may be biased away from the fixed end by the first joint surface, and relative rotation of the nut and the head about an axis of the shank may cause movement of the sliding part with respect to the fixed end.

The head may be located at the fixed end such that rotation of the nut moves the sliding part along the threaded shank.

The nut may be located at the fixed end such that rotation of the head moves the sliding part with the head in relation to the fixed end.

In this way, a portion of the threaded shank between the head and the nut is under tension.

The second joint surface may be arrangable in mere contact with the first joint surface to form a joint. The second joint surface may not be connected to the first joint surface by any means other than mere contact. The second joint surface may be arranged in contact with the first joint surface to form a planar joint; that is, a joint with one rotational and two translational degrees of freedom. The first joint surface and/or the second joint surface may be further constrained such that the first and second joint surfaces may move with respect to each other substantially only in one translational degree of freedom. The first and/or second joint surface may be substantially flat; however, in some embodiments, the first and/or second joint surfaces may be substantially curved, such that relative movement between the two joint surfaces corresponds to relative rotation about a common axis. The joint may operate as a revolute, pin or hinge joint.

The system may comprise at least one pair of opposed gripping parts for securely holding a section of the flat panel, and may comprise at least one pair of adjustment parts, each adjustment part comprising a respective second joint surface arrangable in contact with a respective first joint surface of one of the pair of gripping parts, to form a respective joint, wherein reducing the distance between the second joint surface and the fixed end of one of the pair of adjustment parts, and/or increasing the distance between the second joint surface and the fixed end of the other of the pair of adjustment parts, may result in pivoting of the panel within the trough about an axis parallel to a longitudinal length of the trough. The system may comprise a plurality of pairs of opposed gripping parts spaced along the trough.

The opposed gripping parts may comprise a single gripping part extending around the panel. Alternatively or additionally, a series of gripping parts on one side of a panel may comprise a single gripping part. Similarly, a series of adjustment parts (and or components thereof) may comprise a single adjustment part (and/or a component thereof).

According to a second aspect of the present invention, there is provided a balustrade comprising: the system of the first aspect; a substantially flat panel arranged to be held by the gripping part; and resin disposed between the pair of resilient barrier units in the trough.

According to a third aspect of the present invention, there is provided a method of adjusting alignment of a flat panel, the method comprising: providing a flat panel; providing a system according to the first aspect; attaching the trough to a surface; engaging the contact surface of the gripping part with a face of the flat panel; securely holding a section of the flat panel with the gripping part; locating the gripping part within the longitudinal trough with the joint surface at least partially facing the open side of the trough opposing the base; engaging at the adjustment part at its first end to one of the side walls of the trough; arranging the second joint surface in contact with the first joint surface to form a joint; changing the distance between the second joint surface and the fixed end of the adjustment part; applying a force with the second joint surface onto the first joint surface; gripping the panel with the gripping part; urging the panel with the gripping part toward the base of the trough; pivoting of the panel within the trough about an axis parallel to a longitudinal length of the trough; placing the pair of resilient barrier units in the trough at opposing ends of the adjustment part; introducing liquid resin into a region of the trough between the pair of resilient barrier units; and hardening the resin.

The resilient barrier units may be placed in the trough prior to, or after the step of: attaching the trough to a surface; engaging the contact surface of the gripping part with a face of the flat panel; securely holding a section of the flat panel with the gripping part; locating the gripping part within the longitudinal trough with the joint surface at least partially facing the open side of the trough opposing the base; connecting engaging at least one the adjustment part at its fixed first end to one of the side walls of the trough; arranging the second joint surface in contact with the first joint surface to form a joint; reducing changing the distance between the second joint surface and the fixed end of the adjustment part; applying a force being with the second joint surface onto the first joint surface; gripping the panel with the gripping part; urging the panel with the gripping part toward the base of the trough; and/or pivoting of the panel within the trough about an axis parallel to a longitudinal length of the trough.

For robustness, resin may be inserted on opposing sides of the panel to be secured. However, where robustness is only required in one rotational direction, resin may be inserted on only one side of the panel. In this way, removal of the panel after fixing may be possible, by merely removing the securing system on a single side of the panel.

The region in which the resin is inserted may be bounded by the barrier units in an axial direction, the adjustment part in an upward direction, and/or the trough and the gripping part in a lateral direction. In particular, in use, the resin may not come into contact with the panel, and thus the resin is not bonded to the panel.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
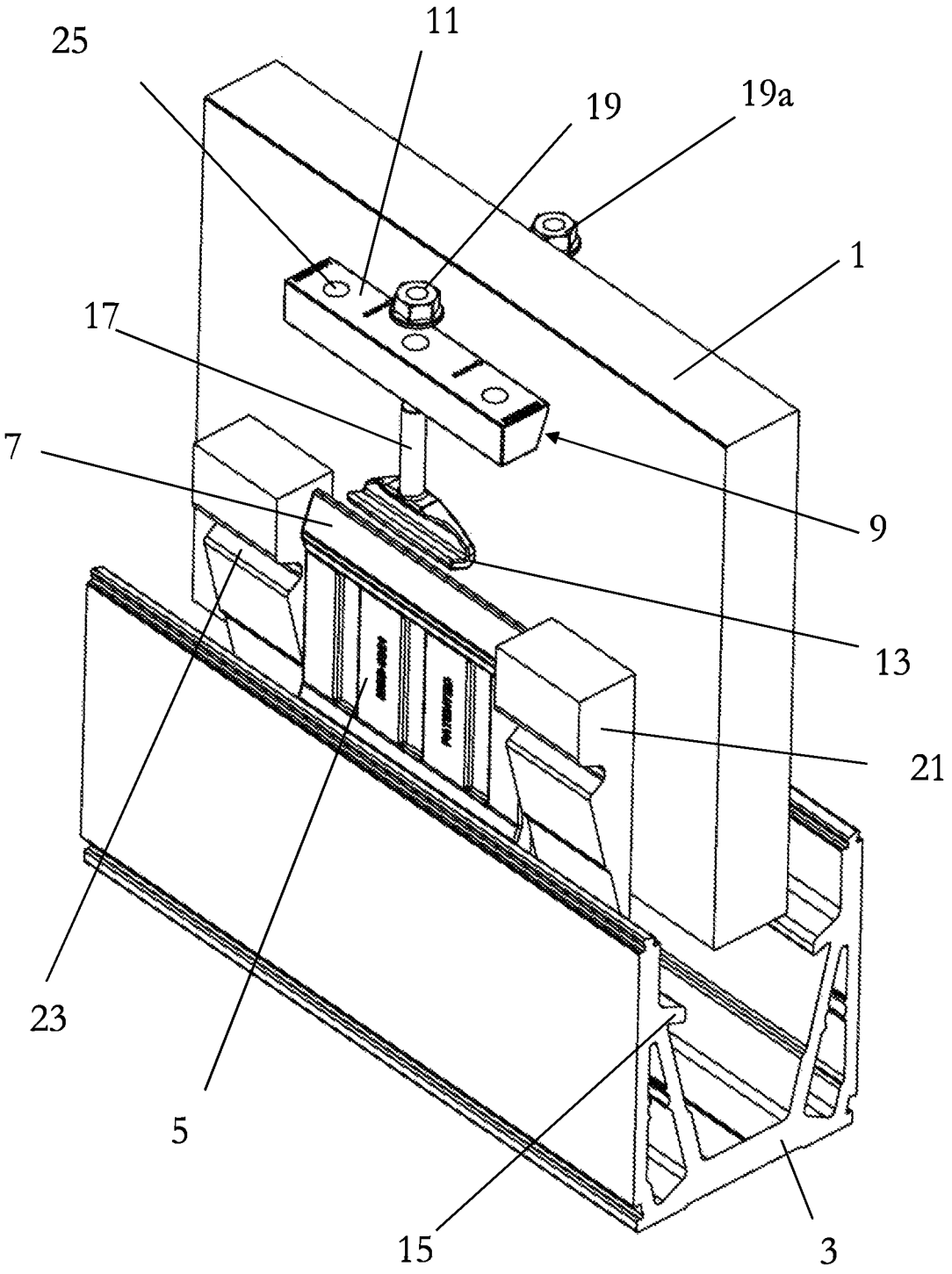
FIG. 1 shows an exploded view of a panel support system.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

FIG. 1 shows an exploded view of a panel 1 to be held in a trough 3, by a gripping part 5 that is arranged with a flat surface thereof engaged with a face of the panel 1 and an upwardly-facing oblique surface 7 angled away from the panel 1.

A corresponding oblique face 9 of an attachment unit 11 is arranged for engagement with the oblique surface 7. A hook 13 is configured to engage with a corresponding lip 15 within the trough 3, the hook 13 being coupled to attachment unit 11 via an externally threaded shaft 17 (threads not shown for clarity) and a corresponding internally threaded nut 19. Tightening of the nut 19 causes the hook 13 to be drawn toward the attachment unit 11. When the hook is engaged with the lip 15, tightening of the nut 19 draws the attachment unit 11 down into the trough 3, pushing the oblique face 9 against the oblique surface 7 and acting to urge the panel 1 into the base of the trough 3 and away from the lip 15 in a lateral direction.

A similar arrangement on an opposing side of the panel 1 pushes back in the opposite lateral direction, thereby clamping the panel 1 in the trough. Only nut 19*a* of the similar arrangement can be seen in FIG. 1.

Two resilient foam wedges 21 are provided at each end of the attachment unit, and are shaped to conform to the inner profile of the trough 3 (including cut-out sections 23 to receive the lip 15). The exact shape of the wedges 21 is unimportant, as they are configured to conform to the internal shape of the trough 3 and panel 1, respectively.

Through holes 25 in the attachment unit 11 are provided to permit injection of liquid resin into the void beneath the attachment unit 11 and bounded by the gripping part 5, trough 3 and wedges 21. The attachment unit 11 shows two through holes 25, one at each end thereof to permit fluid flow around both axial ends of the hook 13; however, a single hole is also considered.

Figure 2:
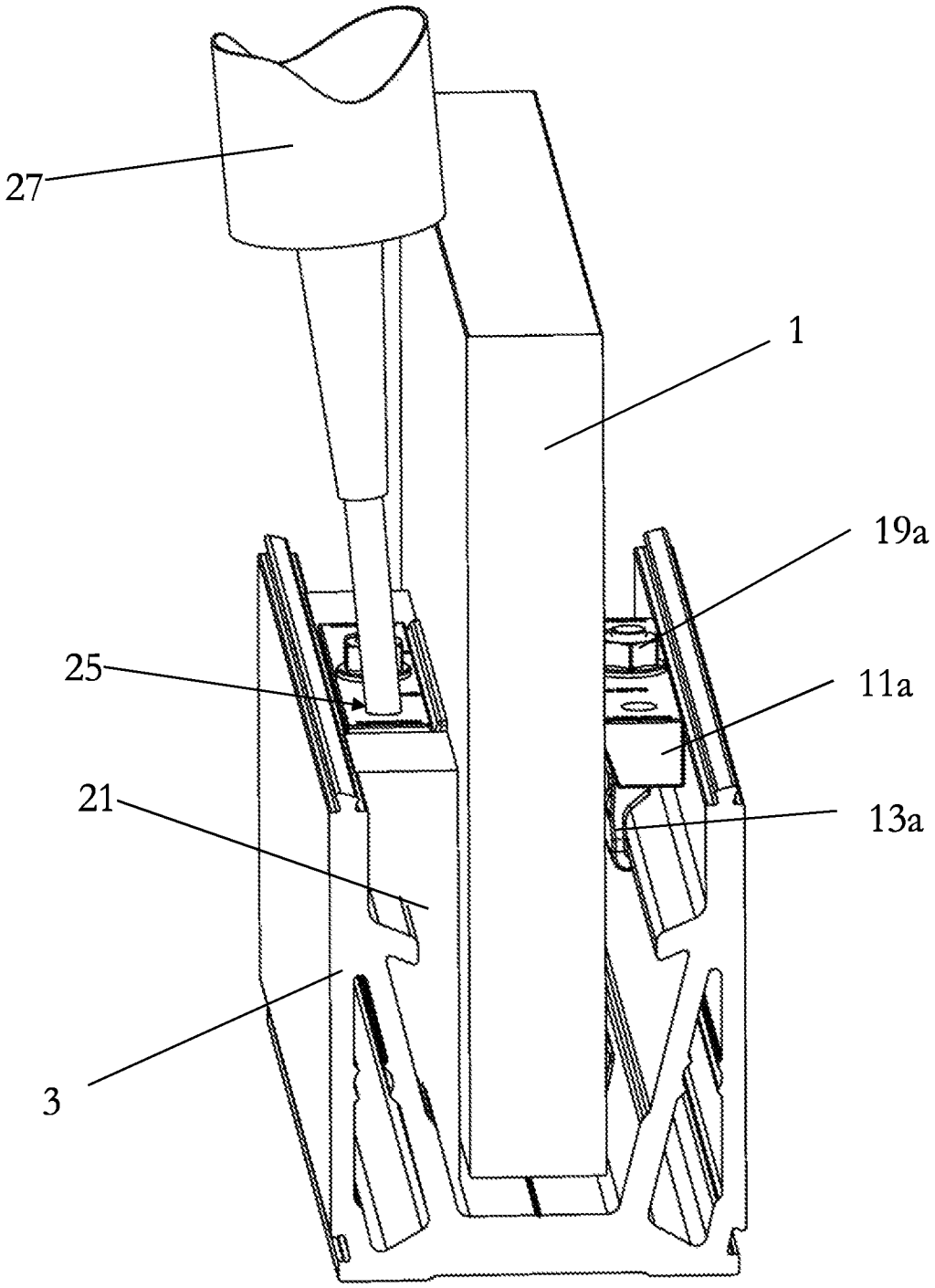
FIG. 2 shows a perspective view of the panel support system.

FIG. 2 shows a perspective view of the assembled panel support system, with resin being injected into the void via through hole 25 from reservoir 27.

The nut 19*a*, attachment unit 11*a* and hook 13*a* of the similar arrangement on the opposing side of the panel 1 can also be seen in FIG. 2. There are no wedges 21 on the opposing side of the panel 1, and resin is not used.

Figure 3:
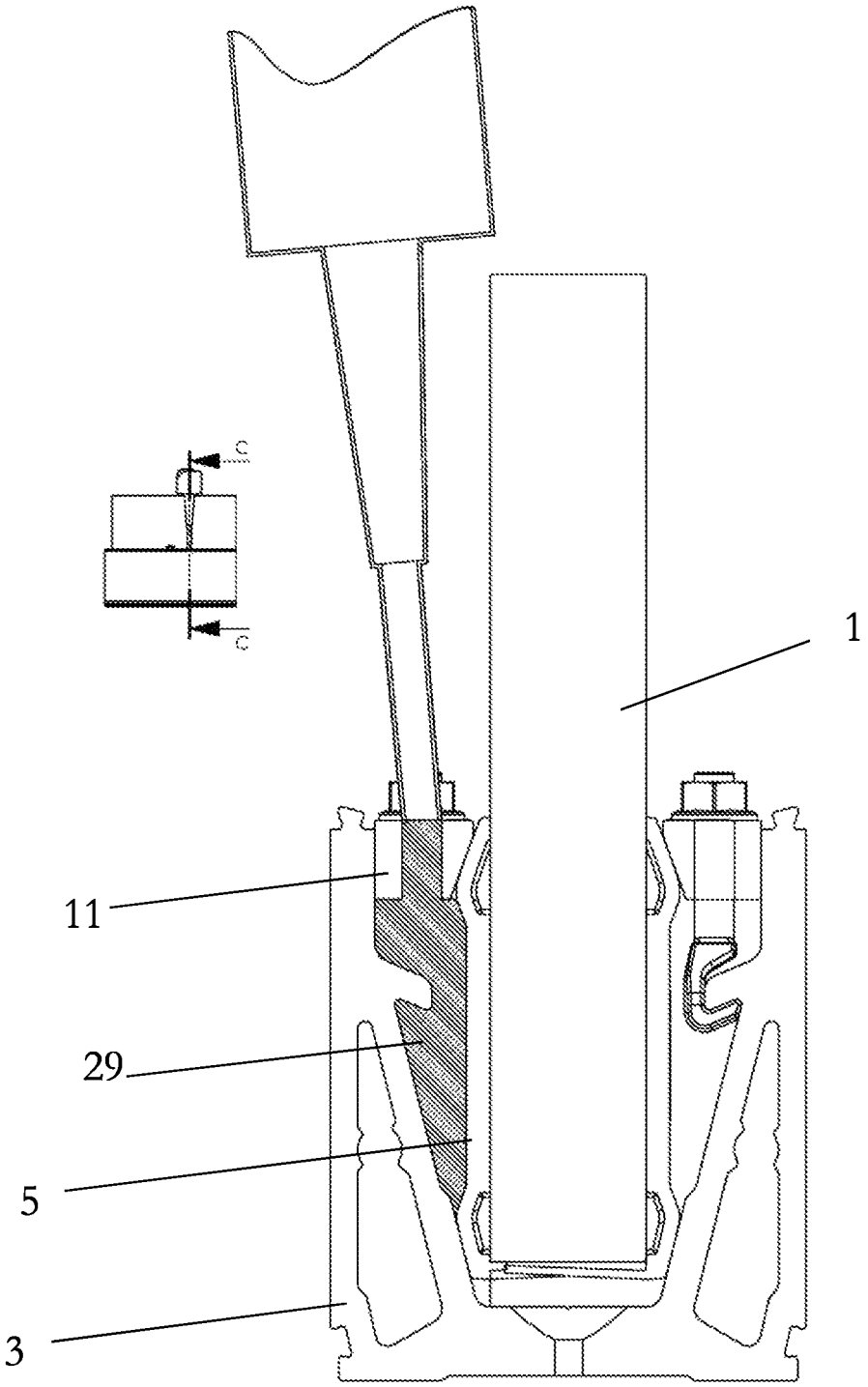
FIG. 3 shows a cross-sectional view of the panel support system.

FIG. 3 shows a cross-sectional view along C-C of the panel support system. Resin 29 can be seen to fill the void between the attachment unit 11, gripping part 5, trough 3 and wedges (not shown). In this arrangement, the resin 29 does not contact the panel 1.

The invention claimed is:

1. A system for adjusting alignment of a flat panel, the system comprising:

a longitudinal trough having two opposing side walls and a base connected therebetween, the trough being open on a side opposing the base, the trough configured to be attachable to a surface;

a gripping part configured to securely hold a section of the flat panel, the gripping part having a contact surface for engaging with a face of the flat panel and a first joint surface inclined obliquely to the contact surface, the gripping part locatable within the longitudinal trough with the joint surface at least partially facing the open side of the trough opposing the base;

an adjustment part having a first end configured to be engaged with one of the side walls of the trough, the adjustment part having a second joint surface spaced from the first end of the adjustment part by a distance that is adjustable by a user, the second joint surface arrangable in contact with the first joint surface to form a joint, wherein changing the distance between the second joint surface and the first end of the adjustment part results in:

a force being applied by the second joint surface onto the first joint surface, resulting in the gripping part gripping the panel and urging the panel toward the base of the trough; and pivoting of the panel within the trough about an axis parallel to a longitudinal length of the trough; and at least one pair of resilient barrier units configured to be placed in the trough at opposing ends of the adjustment part to prevent liquid resin flowing along the longitudinal length of the trough, wherein each said resilient barrier unit is composed of a cellular material.

2. The panel support system of claim 1, wherein the cellular material further comprises a foam material.

3. The panel support system of claim 1, wherein the adjustment part is configured to seal a region within the trough between the pair of resilient barrier units.

4. The panel support system of claim 3, wherein the adjustment part further comprises a resin inlet, for introduction of resin into the region therethrough.

5. A balustrade comprising:

the system of claim 1;

a substantially flat panel arranged to be held by the gripping part; and the liquid resin disposed between the pair of resilient barrier units in the trough.

6. A method of adjusting alignment of a flat panel, the method comprising:

providing the flat panel;

providing the system according to claim 1;

attaching the trough to the surface;

engaging the contact surface of the gripping part with the face of the flat panel;

securely holding the section of the flat panel with the gripping part;

locating the gripping part within the longitudinal trough with the first joint surface at least partially facing the open side of the trough opposing the base;

engaging the adjustment part at the first end to one of the side walls of the trough;

arranging the second joint surface in contact with the first joint surface to form the joint;

changing the distance between the second joint surface and a fixed end of the adjustment part;

applying the force with the second joint surface onto the first joint surface;

gripping the panel with the gripping part;

urging the panel with the gripping part toward the base of the trough;

pivoting the panel within the trough about the axis parallel to the longitudinal length of the trough;

placing the pair of resilient barrier units in the trough at the opposing ends of the adjustment part;

introducing the liquid resin into a region of the trough between the pair of resilient barrier units; and hardening the liquid resin.

* * * * *